United States Patent [19]

Williams

[11] Patent Number: 4,972,557

[45] Date of Patent: Nov. 27, 1990

[54] COIN HOLDER FOR BELT BUCKLE OR THE LIKE

[75] Inventor: Kent B. Williams, Columbus, Mont.

[73] Assignee: Montana Silversmiths, Columbus, Mont.

[21] Appl. No.: 519,029

[22] Filed: May 4, 1990

[51] Int. Cl.[5] ..... A44B 11/00

[52] U.S. Cl. ..... 24/163 K; 24/163 R; 224/163

[58] Field of Search ..... 24/163 K, 163 R, 163 FC, 24/49 K; 224/163; 63/29.1

[56] References Cited

U.S. PATENT DOCUMENTS

| | | | |
|---|---|---|---|
| 1,429,641 | 9/1922 | Sayko | 24/163 K |
| 2,840,875 | 7/1958 | Chambers | 24/163 K |
| 4,377,939 | 3/1983 | Reinsdorf | 24/163 K |
| 4,570,308 | 2/1986 | Weisgerber | 224/163 |

*Primary Examiner*—Victor N. Sakran

*Attorney, Agent, or Firm*—Dorsey & Whitney

[57] ABSTRACT

A coin holder for a belt buckle or the like for mounting a coin within a belt buckle in which the coin can be easily removed and/or replaced by the user.

13 Claims, 2 Drawing Sheets

COIN HOLDER FOR BELT BUCKLE OR THE LIKE

BACKGROUND OF THE INVENTION

1. Field Of The Invention

The present invention relates generally to a coin holder for a belt buckle or the like, and more particularly, to a coin holder for a belt buckle or other display medium in which the coin can be readily removed and/or replaced.

2. Description Of The Prior Art

It is common practice to issue commemorative coins or coin type momentoes such as medals or the like (all of these together with conventional coins hereinafter referred to as "coins") to commemorate or celebrate a particular event, occasion, etc. Along with the issuance of such coins, the recipients or owners have had a desire to display them. In some cases such coins have been displayed in frames, while in other cases, such coins have been displayed on a belt buckle or the like in which the coin is attached to the buckle by means of a coin retaining bezel. In one such attachment means, the bezel is permanently secured to the front face of the belt buckle, with the coin being held to the bezel by a plurality of tabs or one or more peripheral edge portions which are bent over an outer edge of the coin after it has been inserted. In a second attachment means, a coin frame is attached to the front of the buckle with bolts and nuts.

The above identified prior art method of securing a coin to a belt buckle or the like includes several undesirable features. First, the coin retaining bezels of the prior art are attached to the front face of the buckle. Thus, the coin is raised above the belt buckle by an amount at least as much as the coin thickness plus the bezel thickness. This results in a coin display which is generally unattractive because the coin looks like an add-on to the belt buckle rather than being designed into the overall product appearance. Secondly, the prior art belt buckle coin holders are intended to permanently retain the coin in the belt buckle or to permit only a limited number of removals or replacements. For example, current belt buckle coin holders include a plurality of tabs or edge portions which are bent over the peripheral edge of the coin after it has been inserted. If removal of the coin is desired, the tabs or edge portions must be bent back. This repeated bending of the tabs or edge portions not only results in deformation of the tabs or edge portions, and thus general unattractiveness of the coin holder, but can also result in the tabs or edge breaking off or becoming permanently distorted. Thirdly, prior belt buckle coin holders permit viewing of only one side of the coin.

Accordingly, there is a need in the art to provide an improved coin holder for a belt buckle or the like in which the coin is mounted and retained in the belt buckle at a position which is generally flush with the front surface of the buckle or which gives the appearance of being designed into the buckle. There is also a need in the art to provide a coin holder for a belt buckle or the like in which the coin can be repeatedly removed and replaced without distortion of the coin holding mechanism or without removing screws or bolts and in which both sides of the inserted and retained coin can be viewed.

SUMMARY OF THE INVENTION

In contrast to the prior art, the present invention relates to a coin holder for a belt buckle or the like which meets the needs of the art, and more particularly, to a coin holder for a belt buckle which is retained in a position where both sides of the coin are visible and in which the coin can be easily removed by the user for replacement, cleaning, etc.

In general, the structure of the coin holder of the present invention includes an insertable coin holding ring or bezel which is insertable into a centrally positioned opening in the belt buckle for retention therein via a press or interference fit, soldering or the like. The bezel includes an edge portion for retention within the belt buckle opening and a coin holding seat with dimensions facilitating the seating of the coin within the bezel. The bezel also includes means for retaining the coin within the coin retaining seat. This means includes a generally annular groove portion having a diametrical dimension greater than the diametrical dimension of the coin and an insertable retaining member having a first portion insertable within the retaining groove and a second portion engageable with the rearward surface of the coin for retaining and biasing the coin into engagement with the coin holding seat. In the preferred embodiment, the retaining member includes a member such as an O ring disposed within the retaining groove or a clip member extending transversely between portions of the retaining groove, or both.

Accordingly, it is an object of the present invention to provide a coin holder for a belt buckle or the like in which the front surface of the coin is retained in a position which gives the appearance of being designed into the product.

Another object of the present invention is to provide a coin holder for a belt buckle or the like in which the coin can be easily removed and/or replaced by the owner.

A still further object of the present invention is to provide an improved coin holder for a belt buckle or the like which permits viewing both sides of the coin while it is mounted in the product.

A further object of the present invention is to provide a coin holder for a belt buckle or the like which provides for all of the above features.

These and other objects of the present invention will become apparent with reference to the drawings, the description of the preferred embodiment and the appended claims.

DESCRIPTION OF THE PREFERRED EMBODIMENT

Figure 1:
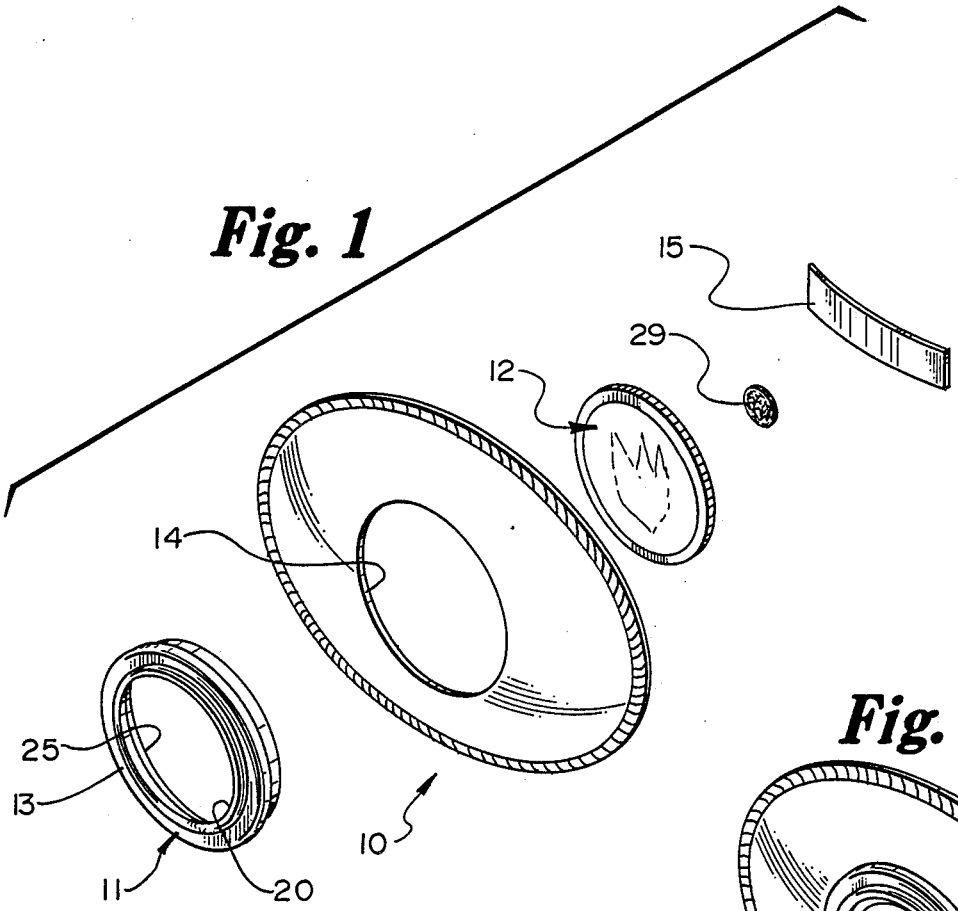
FIG. 1 is a perspective, broken apart, view of the belt buckle and coin holder of the present invention.
Figure 2:
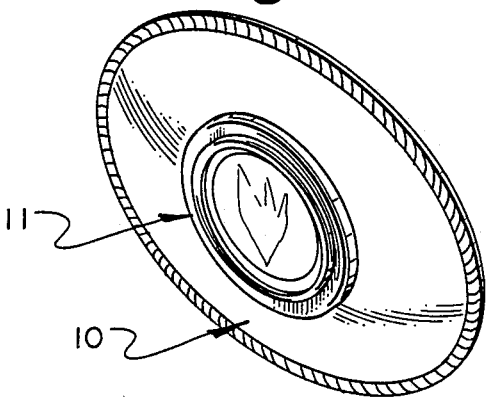
FIG. 2 is a perspective view of the front face of a belt buckle incorporating the coin holder of the present invention.
Figure 3:
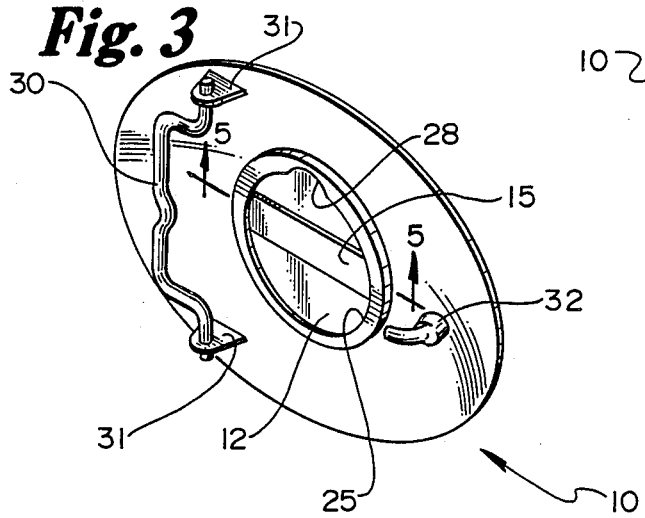
FIG. 3 is a perspective view of the rear face of a belt buckle embodying the coin holder of the present invention.

Reference is first made to FIG. 1 showing a perspective, broken apart, view of the belt buckle and coin holder of the present invention. As shown, a belt buckle or the like 10 is provided with a centrally positioned opening 14, a coin holding ring or bezel 11 which is insertable into the opening 14 for retention therein, and a means in the form of the retaining clip or member 15 for retaining a coin 12 in seated position relative to the bezel 11. As shown in FIGS. 2 and 3, the belt buckle 10 is a generally oval buckle having front and rear faces which includes conventional belt buckle hardware 30, 31 and 32 on its rear side. The opening 14 extends from the front to the rear face of the belt buckle 10 and includes an opening axis generally perpendicular to the front face of the buckle 10.

As illustrated best in FIG. 3, the bezel 11 includes an outer annular edge 16 which is adapted for insertion into and through the opening 14 in the buckle 10. A portion of this edge 16 is provided with a fluted edge 18 comprised of alternate ribs and grooves to facilitate connection within the opening 14.

In the preferred embodiment, the bezel 11 is designed to be retained within the opening 14 by any conventional means such as a press or interference fit or by soldering or the like. Accordingly, the relationship between the size and configuration of the opening 14 and the outer annular edge 16 must approximate one another to permit this connection. If a press or interference fit is utilized, the outer dimension of the fluted edge portion 18 should be slightly larger than the opening 14 to permit a retaining interference between the two surfaces. It is contemplated that the opening 14 can be of various sizes and shapes to accommodate various corresponding sizes and shapes of bezels 11 and to thus hold various sizes and shapes of coins.

Positioned adjacent to the edge 16 and extending radially outwardly from the edge 16 is a radial surface portion 19 which, when the bezel is inserted into the opening 14, engages the front face of the belt buckle 10. This surface 19 joins with a front bezel surface portion 13. The front surface portion 13 is a generally ring shaped surface portion and includes a ring shaped rib portion 17. The surface portion 13 is defined by inner and outer spaced continuous edges, 20 and 30, respectively. The inner edge 20 defines a coin display window for the coin.

Positioned immediately to the rear of the inner surface 20 and the coin display window is a coin holding seat defined in part by the radial surface portion 21 and in part by the inner annular surface portion 22. The inner edge of the radial surface portion 21 is joined with the edge 20, while the outer edge of the radial surface portion 21 joins with the annular surface 22. As shown, the surface portion 21 is disposed in a plane generally perpendicular to the opening axis of the opening 14 and bezel 11. The surface 22 is generally parallel to such axis. To enable the coin holding seat to function satisfactorily, the dimension of the surface 22 must be sufficient to permit the coin 12 to be seated for engagement with the surface portion 21. Preferably, the diametrical dimension of the surface 22 should be slightly larger than that of the coin 12 to permit the coin to freely engage the surface 21. The inner edge 20 must have a diametrical dimension less than that of the coin 12.

Figure 4:
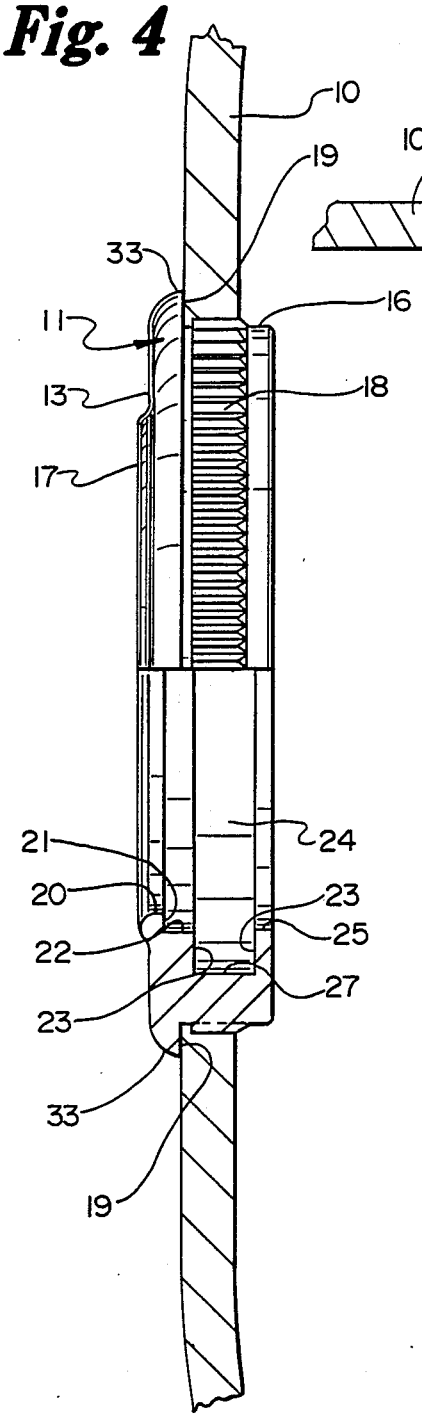
FIG. 4 is a side view showing the coin holding bezel in half section as retained within a belt buckle.

The bezel 11 also includes means for retaining the coin 12 in a seated position relative to the surfaces 21 and 22. In the preferred embodiment, this means includes a coin retaining groove 24 and a coin retaining member such as the elongated clip member 15 illustrated in FIG. 1 or the O ring 26 illustrated in FIG. 6. In the preferred embodiment illustrated in FIG. 4, the coin retaining groove 24 is defined by a pair of parallel radial surfaces 23 and an inner annular surface 27. The groove 24 is positioned rearwardly of the surface portion 22 and extends entirely around the bezel 11. As shown, the retaining groove 24 is bordered on its forward side by the seat surface portion 22 and on its rearward side by the inner annular surface portion or lip 25.

The diametrical dimension of at least a portion of the groove 24 must be greater than the diametrical dimension of the lip 25 to permit a retaining member such as the clip 15 or the O ring 26 to be retained within the groove 24. Also, the inner diametrical dimension of the lip 25 must be larger than the diametrical dimension of the coin 12 to permit the coin 12 to be inserted past the lip 25 and into seating engagement with the seat surfaces 21 and 22.

Figure 7:
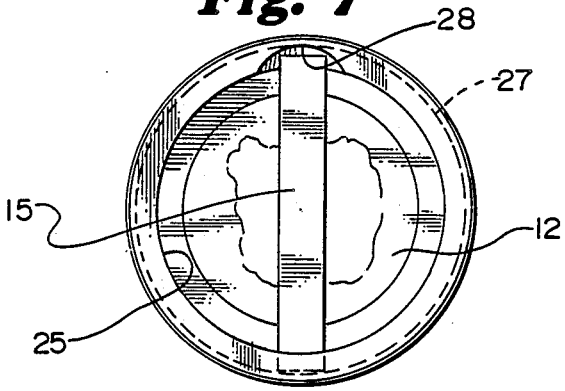
FIG. 7 is an elevational view of the rear side of the coin holding bezel showing a coin in position for retention and the retaining member as it is inserted.

As illustrated best in FIGS. 3 and 7, the lip 25 includes a recessed portion 28 to permit installation of an elongated retaining member such as the clip member 15. As shown in FIG. 7, the size of the recessed area 28 must be sufficient to permit the elongated clip 15 or similar member to be inserted within the retaining groove 24 and retained therein upon rotation.

Figure 5:
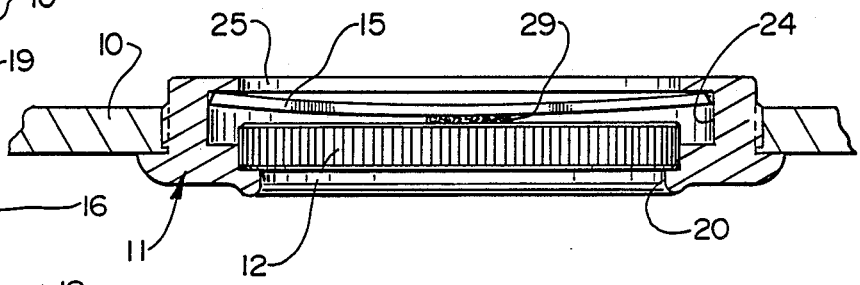
FIG. 5 is a fragmentary view, partially in section, showing a coin retained within the coin holding bezel as viewed along the section lines 5—5 of FIG. 2.

In the preferred embodiment, the clip member 15 is a generally elongated, rectangular shaped member having a longitudinal dimension which is greater than the diametrical dimension of the lip 25, but less than the diametrical dimension of the groove 24. The forward surface of the clip member 15 is provided with a cushion pad 29 such as a felt pad or the like for engagement with the rear surface of the coin 12 when inserted. Also, the clip member 15 is preferably prestressed into a generally bow shape as shown in FIGS. 1 and 5 so that when it is inserted into a retaining position, outer edges of the clip member 15 are retained within the groove 24 and the cushion member 25 is biased against the rearward face of the coin 12 to retain the coin 12 in its seated and retained position. This installed position of the clip 15 is shown best in FIG. 5. The clip 15 or other retaining member must have a first portion for engagement with a portion of the groove 24 and a second portion engaging a portion of the rearward surface of the coin 12.

Figure 6:
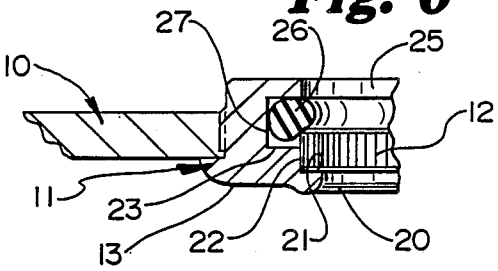
FIG. 6 is a view, partially in section, of one edge of the coin holding bezel as retained in the belt buckle and showing an alternate means of retaining the coin within the bezel.

Alternatively, a gasket member such as a rubber 0 ring or similar retaining member or snap ring can be inserted into the groove 24 to retain the coin in a seated position as illustrated in FIG. 6. It is also possible to use both a retaining member such as the O ring 26 or a snap ring, as well as an elongated member such as the clip 15 which bridges portions of the groove 24.

Having described the structure of the coin holder of the present invention, the assembly can be best understood as follows. Initially the bezel 11 is inserted into the opening 14 of the buckle 10 and retained therein either by a press or interference fit, soldering, or the like. In a press fit, the bezel 11 is retained by interference between the edge portion 18 and the edge of the opening 14. The coin 12 is then inserted into the bezel 11 from the rearward side such that the desired display face of the coin faces forwardly through the display window defined by the edge 20 and such that the outer peripheral edge and surface portions of the coin are seated against the seat surface portions 21 and 22. A clip member 15 is then inserted into the groove 24 as illustrated in FIG. 7 and rotated to the position illustrated in FIG. 3. In this position, as illustrated in FIG. 5, the opposite ends of the clip member 15 are retained within the groove 24 and the center portion of the front surface of the clip 15 containing the cushion member 29 biases the coin 12 into a retained position against the seat surface 21.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

I claim:

1. A belt buckle or the like having a coin holder for retaining a coin therein, said belt buckle having a front and a rear face and comprising:

an opening extending through said belt buckle from said front face to said rear face and having an opening axis generally perpendicular to said front face;

a coin holding bezel insertable into and retained within said opening, said coin holding bezel including a front bezel surface disposed forward of said front face of said belt buckle, and having an inner continuous edge and an outer continuous edge spaced from said inner continuous edge;

a display window defined by said inner continuous edge;

a coin holding seat positioned rearwardly of said display window and having dimensions facilitating the seating of the coin;

a retaining groove positioned rearwardly of said coin holding seat, at least a portion of said retaining groove having a dimension greater than the diametrical dimension of said coin, and a retaining member positionable within said retaining groove such that a portion of said retaining member is inserted within said groove for retaining engagement therewith and a portion extends out of said groove and in retaining engagement with the rear face of said coin.

2. The belt buckle of claim 1 wherein said inner continuous edge has a diametrical dimension less than that of said coin.

3. The belt buckle of claim 2 wherein said coin holding seat includes a first annular surface portion extending in a direction generally parallel to said opening axis and a radial surface portion having an outer seat edge joined with said annular surface portion and an inner seat edge joined with said inner continuous edge.

4. The belt buckle of claim 3 wherein said retaining groove includes a second annular surface portion extending in a direction generally parallel to said opening axis and a retaining lip portion positioned rearwardly of said second annular surface portion and having an inner lip edge.

5. The belt buckle of claim 4 wherein said second annular surface portion has a diametrical dimension greater than that of said coin and said inner lip edge has a diametrical dimension less than that of said second annular surface portion, but sufficiently large to permit passage of said coin.

6. The belt buckle of claim 5 wherein said retaining member includes an elongated clip member having a pair of edge portions inserted into said retaining groove for retaining engagement therewith and a central portion positioned between said pair of edge portions for retaining engagement against the rear face of said coin.

7. The belt buckle of claim 6 wherein said retaining clip member has a longitudinal dimension greater than the diametrical dimension of said inner lip edge and less than the diametrical dimension of said second annular surface portion.

8. The belt buckle of claim 7 wherein said retaining clip member is prestressed into a bow shaped configuration with the bowed portion in retaining engagement with the rear face of said coin.

9. The belt buckle of claim 8 wherein said bowed central portion includes a coin retaining pad.

10. The belt buckle of claim 7 wherein said inner lip edge includes a recessed portion to facilitate insertion of said clip member into said retaining groove.

11. The belt buckle of claim 6 wherein said central portion includes a coin retaining pad.

12. The belt buckle of claim 5 wherein said coin retaining member includes a retaining gasket position in said coin retaining groove.

13. The belt buckle of claim 12 wherein said gasket is an O ring.

* * * * *